United States Patent [19]

Bear

[11] Patent Number: 4,915,384

[45] Date of Patent: Apr. 10, 1990

[54] PLAYER ADAPTIVE SPORTS TRAINING SYSTEM

[76] Inventor: Robert A. Bear, 12997 Merriman Rd., Livonia, Mich. 48150

[21] Appl. No.: 222,047

[22] Filed: Jul. 21, 1988

[51] Int. Cl.[4] ..... A63B 69/40

[52] U.S. Cl. ..... 273/26 R; 273/29 A; 273/26 A; 273/26 D; 273/185 B; 273/1 B; 273/1 E; 273/1 GE; 273/1 GC; 434/247; 434/258

[58] Field of Search ..... 273/26 R, 29 A, 185 B, 273/1 B, 25, 26 A, 26 D, 29 R, 1 E, 1 GC, 1 GE; 434/247, 258; 124/5; 340/323 R

[56] References Cited

U.S. PATENT DOCUMENTS

| | | | |
|---|---|---|---|
| 4,070,018 | 1/1978 | Hodges | 273/29 A |
| 4,086,630 | 4/1978 | Speiser et al. | 273/185 B |
| 4,269,163 | 5/1981 | Feith | 273/29 A |
| 4,552,120 | 11/1985 | Nall et al. | 273/26 R |
| 4,577,863 | 3/1986 | Ito et al. | 273/26 R |
| 4,607,842 | 8/1986 | Daoust | 273/1 B |
| 4,702,475 | 10/1987 | Elstein et al. | 273/29 A |
| 4,751,642 | 6/1988 | Silva et al. | 273/185 B |
| 4,767,121 | 8/1988 | Tonner | 273/185 B |

*Primary Examiner*—Edward M. Coven
*Assistant Examiner*—Jessica J. Harrison
*Attorney, Agent, or Firm*—Krass and Young

[57] ABSTRACT

An adaptive sports training system accommodates its performance to a player's level of skill. The system is adapted to deliver a ball to a player for return to a target. The system includes a processor programmed to (1) receive information from the target or from a bat indicative of the striking of the ball, (2) process that information so as to determine the player's level of skill and (3) control the delivery of balls and/or function of the target in accordance with the player's changing skill level.

30 Claims, 2 Drawing Sheets

PLAYER ADAPTIVE SPORTS TRAINING SYSTEM

FIELD OF THE INVENTION

This invention relates generally to sports training aids and more particularly to sports training systems which throw a ball to a player for hitting, catching or otherwise returning. Most particularly the present invention relates to a sports training system which is capable of adapting its responses to the player's particular performance level.

BACKGROUND OF THE INVENTION

With the increase in leisure time available to the general population, sports on the amateur and professional level are of ever increasing popularity and consequently have become a major business enterprise. Increasing numbers of fans are attending spectator sporting events as well as participating in individual sports. Concomitant with the increase in sporting activities is a growing interest in sports training on both the professional and amateur level.

Traditionally, training has been carried out by coaches, teachers and other professional persons; however, individual coaching is not always available due to costs or lack of trained personnel. In response to the shortage of skilled coaching personnel and the ever increasing need for training, various mechanical systems have been developed to enhance player ability.

The earliest such systems were utilized to train baseball batters and generally comprised machines for pitching baseballs. The first machines were capable of throwing a single type of pitch at a generally fixed rate of speed, however such machines have increased in sophistication and can now deliver balls at variable rates of speed and in some instances can pitch curves and other breaking balls. Another type of training aid involves targets or other scoring systems adapted to register the hit of a returned ball. Such targets may simply comprise a wall or backstop with a target zone, or in more sophisticated systems may include electronic sensors to detect the position of the hit, as well as indicators for delimiting target areas. Such systems are well represented in the patent art. For example, U.S. Pat. No. 4,309,032 discloses a tennis backboard which can be activated in a predetermined sequence to indicate sections thereof to be hit by the player and to score a number of times such indicated sections are hit. Pat. No. 4,029,315 discloses a football evaluation system in which a target selectively indicates predetermined areas to be struck by a thrown ball and also evaluate the accuracy and strength of a player in throwing a ball to such preselected sections. Pat. No. 4,563,005 discloses a baseball target including a plurality of infrared detectors for determining the trajectory of a thrown baseball.

In some instances ball delivery systems have been combined with target systems to provide for a more sophisticated training apparatus. Pat. No. 3,989,246 discloses a tennis practice system which serves a tennis ball to a player and scores a player's performance in returning the ball to a zoned target. Pat. No. 4,116,437 discloses a similar tennis training apparatus which serves balls to a player and scores the return shot on the basis of location as well as speed.

The foregoing apparatus are indicative of the interest in, and need for sports training equipment. However, all of the foregoing apparatus suffer from the general deficiency characterizing the prior art insofar as they are not adaptive in their performance to a player's level of skill. By adaptive, is meant a training system which is capable of sensing a player's level of skill and adjusting its performance to that level on a continuous basis so that in the course of a training session the system will accommodate an increasing or decreasing level of skill. In this regard, adaptive training systems more closely approximate play with a human opponent. While prior art systems may in some instances be preset to approximate various skill levels, as for example by adjusting the speed and placement of thrown balls or by adjusting target areas; a player's skill level will change throughout a game and it is well known that maximum training benefits accrue when a player can train with an opponent capable of establishing a proper pace. As a player's skill improves, a skilled trainer, or an adaptive system can increase the level of challenge presented so as to secure peak performance. Likewise, a skilled trainer or an adaptive system can moderate the level of play to suit a tiring player so as to still maintain interest and motivation.

The need for an adaptive sports training system should be readily apparent from the foregoing, as should be the fact that heretofore available sports training apparatus was not capable of functioning in an adaptive manner. The present invention provides for sports training systems in which a feedback is established from a target or from the player to a ball delivery system whereby a player's accuracy, speed and endurance in returning balls establishes the pace and difficulty of the training regimen. A system of this type may also include a display unit to display the player's score or to display a simulation of a sporting event so as to present realistic decision making situations, which the player will react to by appropriately returning the delivered ball. The system can be readily adapted to a variety of sporting events and in a variety of modes. For example, in a baseball simulation, the system may be used to deliver a pitched ball to a batter or catcher, or to simulate a hit ball for delivery to a fielder or a pitcher who will return the ball to an appropriate section of a target area. These features and advantages of the present invention, as well as other features and advantages will be readily apparent from the drawings, discussion and claims which follow.

SUMMARY OF THE INVENTION

There is disclosed herein an adaptive sports training system for simulating play of a game. The system includes means for delivering a ball to a player; target means disposed so as to be struck by a ball projected by the player and adapted to provide a signal indicative of the skill with which the target is struck. The system further includes a signal processor adapted to (1) receive signals from the target and (2) control the ball delivery means and/or the target means in response to the signals so as to increase or decrease the difficulty of the game in proportion to the skill with which the target is struck so that the training system adapts to and accommodates the skill level of the player. In further embodiments the processor may be adapted to also receive signals from the delivery means indicative of the delivery of the ball and may be further adapted to control the target in response to such signals. The target may include a plurality of regions and a processor may be adapted to control the target so as to indicate which of the regions is to be struck. In particular, the processor may control the value of each region of the target so that the signal produced by the target will depend upon the region struck as well as the nature of the delivery of the ball.

In yet other embodiments, the processor may include display means such as a cathode ray tube or a projector associated therewith and adapted to provide a visual simulation of the game. The processor may be further adapted to compute a player's score based upon the signal generated by the target as well as the particular visual simulation presented. The target may be further adapted to provide a signal indicative of the energy with which the ball strikes as well as a signal indicative of the trajectory of the ball and may include sensors such as infrared sensors or photo sensor.

In specific embodiments, the system may be adapted to deliver a simulated pitched baseball to a player or a simulated hit ball to a player. In other embodiments, the system may be adapted to deliver a simulated served or returned tennis ball to a player whereas in yet other instances the system may deliver a hockey puck or football. The system may include voice recognition circuitry to train the visual observational skills of the player, by requiring vocalization corresponding to displayed indicia.

DETAILED DESCRIPTION OF THE INVENTION

Figure 1:
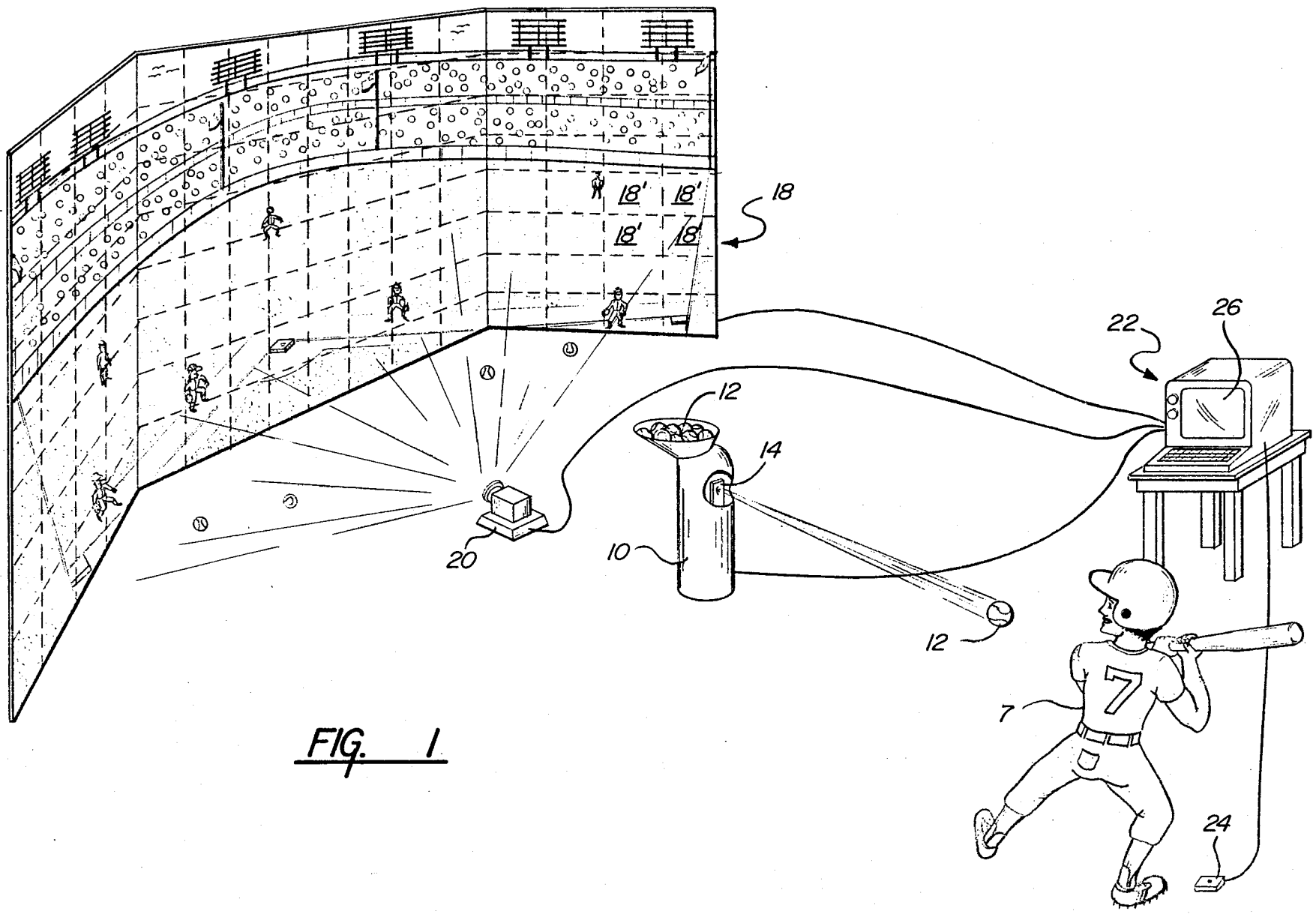
FIG. 1 is a perspective view of one adaptive sports training system structured in accord with the principles of the present invention.

Referring now to FIG. 1 there is shown a stylized view of one particular sports training system structured in accord with the principles of the present invention and adapted to provide a simulation of a baseball game from the perspective of a batter. The system of FIG. 1 includes ball delivery means 10 adapted to pitch a baseball 12 to a player 7. The ball delivery means 10 includes a pitching arm 14 as well as a reservoir 16 of baseballs 12. Various pitching machines of different design are well known to those skilled in the art and may be readily adapted to the present invention. It should be noted that the system of the present invention may be adapted to a variety of sporting events and accordingly the ball delivery machine 10 may be modified to deliver tennis balls, footballs, hockey pucks and other such items.

The system further includes a target 18 disposed to be struck by a baseball 12 hit by the batter 7. As indicated, the target 18 is subdivided into a plurality of regions 18' as is indicated by the grid work of phantom lines. As will be discussed in greater detail hereinbelow, each of these discreet regions 18' is adapted to sense impact of a baseball thereupon and to provide a signal indicative of that impact.

Also included in the system is a projector 20 disposed so as to project a representation of a baseball playing field onto the target 18. The projector may be advantageously configured to project a still scene or by including well-known display technology may be adapted to project a changing scene onto the target 18. Use of a projected display increases the realism of the game and further enhances player skill by requiring the player to hit or throw the ball to a target area in response to the presented scene, thereby increasing powers of concentration and observation.

The system further includes a processor 22 disposed in electrical communication with the target 18, projector 20 and pitching means As will be discussed in greater detail hereinbelow, the processor 22 controls the ball delivery means 10 and target 18 in response to the player's level of skill and may optionally control the projector 20 to provide a realistic game simulation. In the depicted embodiment, there is also included a signaling device such as a sensor or switch 24 disposed in close proximity to the player 7 and in electrical communication with the processor 22. The signaling device 24 may be utilized to control the processor so as to indicate when a player is ready to receive a pitched ball, or to indicate a player's decision to run on a batted ball. Alternatively, the sensor 24 may be a microphone or other such device and may be employed to detect when the player hits the ball. In this context the sensor 24 may be directly mounted on the bat. Input from a "smart bat" of this type can be directly input to the processor and together with information from the target indicating the arrival of the ball, can be used to compute the speed of the batted ball or the player's hitting average.

A smart bat can indicate the force with which a ball is hit as well as the portion of the bat doing the hitting and therefore can predict the nature of the hit (i.e., foul, pop-up, or home run). A smart bat may thus be utilized to assess the players overall skill level in hitting pitched balls, and the signal therefrom, employed to control the pitching machine 10, in an adaptive mode, thereby eliminating the need for a specialized target.

There are many modes in which the sports training system of the present invention may operate and in fact, there are many modes in which the particular embodiment of FIG. 1 may be utilized. In the depicted embodiment, the system is adapted to train a batter and accordingly will be disposed to pitch a baseball 12 to a batter 7. The pitching machine 10 is under control of the processor 22 and may be preprogrammed to pitch a preselected or random grouping of pitches as for example fast balls, curve balls, strikes and balls. In some instances, the pitching machine 10 may be controlled to deliver an occasional wild pitch in order to train a batter to anticipate and react to such pitches. In the simplest embodiment, the player will bat a pitched ball toward the target 18 and impact of the ball will generate a signal in the target 18, which signal is communicated to the processor 22. The signal may be indicative of the portion of the target 18 which is struck, or may further indicate the energy with which the target 18 was struck. By so measuring the impact of the ball, a score for the player may be computed.

The processor 22 can compute a score indicative of the player's performance and utilize this information to control the ball delivery means 10. In this manner, a skillful player may be provided with a challenging series of pitches whereas a less skilled player can be presented with somewhat easier pitches. As a player's skill level improves, the level of pitching will adjust accordingly.

The processor 22 has associated therewith a display such as a cathode ray display 26 and/or a projector 20. The display may be utilized to provide a simulation of a baseball game to a player so as to test strategic playing ability or may be simply employed to display a score. In the depicted embodiment, the projector 20 is in communication with the processor 22 and is adapted to project a simulated baseball game onto the target 18. Through the use of interactive video display technology, such as that presently known and employing optical or magnetic data storage, a changing scene may be projected onto the target 18. For example, a game situation depicting players on base and position of outfielders may be provided to the player 7, who can then adjust his performance in accordance with the displayed scene. Through the use of a video display of this type, a player's powers of observation can be sharpened. The player can be trained to quickly perceive the entire game scene and react appropriately. For example, the projector 20 may display a game situation requiring the player 7 to bunt, or to attempt a home run. Since the projector 20 and ball delivery means 10 are both coupled to the processor 22, the pitch provided to the player 7 can be adjusted in accord with the displayed scene.

The signal means 24 disposed proximate the player 7 is used to indicate the player's state. For example, the signal means 24 may be a pressure sensitive switch employed to designate when the player 7 is in the batter's box. In other instances, the switch 24 may be employed to sense when a player leaves the batter's box to run after batting the ball. In yet other instances, the signal means 24 may comprise a microphone adapted to respond to the sound of a hit ball or an impact sensor disposed on the bat and operating in conjunction with the target 18 and processor 22 to determine the velocity of the batted ball.

Obviously, the system of FIG. 1 may be modified in various ways. For example, the system may be readily configured to simulate a baseball game from the point of view of a pitcher or fielder. In such instance, the ball delivery machine 10 will be adapted to deliver a simulated batted ball as for example to an outfielder. The representation upon the target 18 will be that of a baseball field as seen from the outfielder's vantage point and the player will be required to catch the hit baseball and throw the ball at the target, preferably in response to a game situation projected thereupon. For example, the outfielder may be required to throw the ball to one of the bases in time to stop a runner. In this context, the signal means 24 may comprise a sensor mounted in the player's glove to determine when the ball is caught and/or when the ball is removed from the glove. A player may have an inertial sensor disposed, as for example, on his throwing arm to determine when the ball is thrown back to the target. Such information may be processed so as to determine the velocity of the returned ball as well as the player's reaction time. A "smart" glove can assess a player's overall catching ability and control the ball delivery means in response thereto, eliminating the need for a specialized target; although obviously, such a system cannot assess throwing accuracy.

In the case of a pitcher, the player will be required to pitch a baseball at the target, which target will then sense the impact and/or trajectory of the ball. In response to the impact of a pitched ball, the ball delivery means 10 may be energized to deliver a simulated batted ball which the pitcher will be required to play. For example, the ball delivery machine 10 may deliver a simulated bunt or a line drive to the pitcher.

Obviously, the system of the present invention may be similarly adapted to other sports. For example, the target 18 may display a tennis court and the ball delivery means 10 may be disposed to a deliver a simulated served or returned ball. As in the previous embodiment, the difficulty with which the delivered balls are presented will be determined by the player's skill in returning such balls. The player's score may depend upon simple return of delivered balls or in more complicated embodiments may depend upon striking of particular portions of the target 18 and in this context the target 18 may include means for designating a section to be struck. For example, in one embodiment of tennis training apparatus, the target 18 may include a plurality of lightable or otherwise designatable target sections and the processor 22 may control such sections so as to require a player to return a delivered ball to the designated section in order to obtain a maximum score. As the player's skill improves the designated sections can be made smaller, or can appear for briefer periods of time. In other embodiments, the target may include a projected simulation of a game of tennis and require a player to return a shot to a portion of the court dependent upon simulated position of an opposing player. The player's tennis racket may be provided with an input sensor or similar signal generator to determine when the ball is struck. This information together with a signal generated by the target can be utilized to determine the speed of the returned ball.

One of skill in the art will appreciate that similar adaptive training systems may be implemented for other games such as hockey or football, the central feature of all such systems being that they include a signal processor which senses the player's skill level as indicated by the target 18 and/or the player's hitting or catching of the ball and adjusts the ball delivery means to accommodate that skill level.

Figure 2:
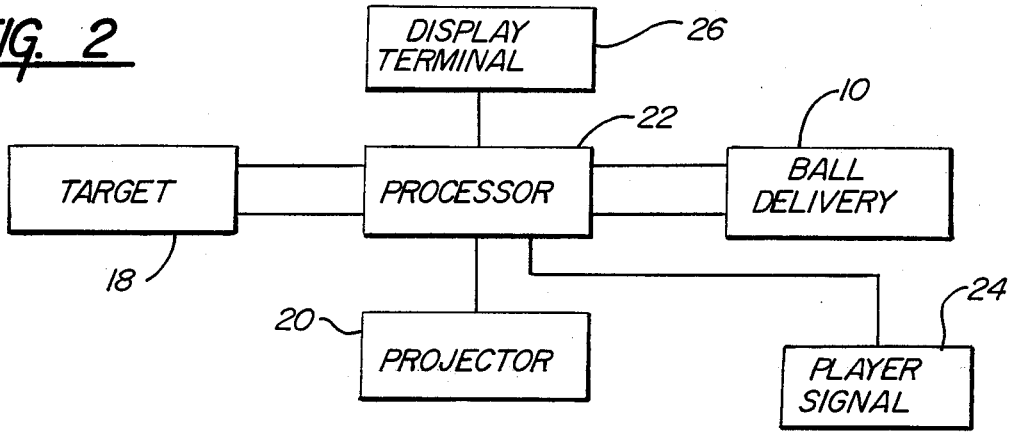
FIG. 2 is a generalized block diagram of an adaptive sports training system.

Referring now to FIG. 2 there is shown a generalized block diagram of a particular training system structured in accord with the principles of the present invention. The system includes ball delivery means 10, as generally described previously, it being understood that such delivery means may be adapted to deliver footballs, baseballs, tennis balls, hockey pucks and the like all of which are collectively referred to as balls. The system also includes a target 18 adapted to provide a signal indicative of its being struck by a ball thrown, hit or otherwise projected by the player.

Central to the apparatus is a processor 22 in two-way communication with the target 18 and ball delivery means 10. The processor 22 is adapted to receive signals from, and provide signals to both the target 18 and ball delivery means 10. For example, a series of balls striking the target 18 will provide information relative to the player's level of skill, particularly if the nature of the pitches made to the player are known. Since the ball delivery means 10 is in communication with the processor, such information regarding the nature of the delivered balls may be readily obtained. The processor 22 receives signals from the target 18 and utilizes such signals to control the ball delivery means 10. Alternatively, the processor may receive signals from the player signal 24 and use those signals to control either or both of the ball delivery means 10 or the target 18.

The processor 22 may be used to further control the target 18 so as to indicate sections the player is to strike. Such indication may be given directly , as for example by illuminating or otherwise designating portions thereof or indirectly, as for example via a projector 20 adapted to control the display upon the target 18.

Also in communication with the processor is a display terminal 26 which may be utilized to display a player's score, to give prompt messages such as the position the player is in for a fielding simulation, or similar indication of the game situation; or as an adjunct to, or replacement for the projected display. Also shown in communication with the processor 22 is a player signal 24. This signal, as mentioned previously communicates the player's status to the processor 22. Such a signal may comprise a pressure sensitive switch indicating when a player is in a batting position, on a pitcher's rubber or awaiting and/or serving a tennis ball. In yet other instances, the player signal 24 may comprise a microphone, photo cell or optical sensor array adapted to detect a hit ball or player movement, and in some instances may be disposed in direct association with a bat or glove.

Figure 3:
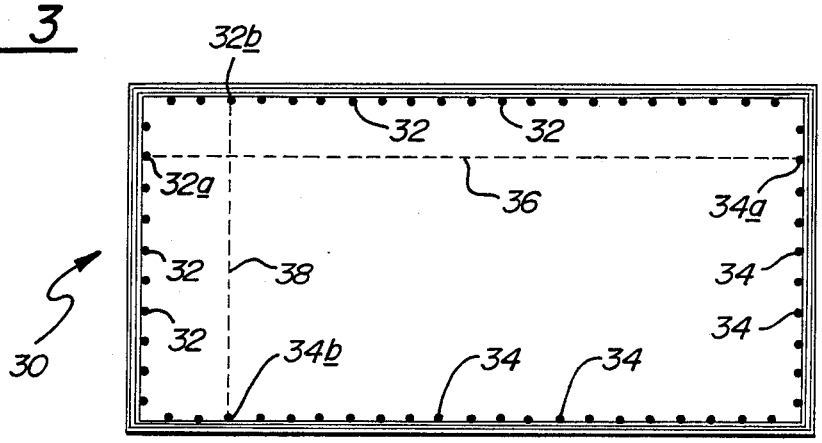
FIG. 3 is a front elevational view of one particular target structured in accord with the principles disclosed herein.

There are a wide variety of targets which may be employed in the practice of the present invention, the criterion being that the target employed is adapted to provide a signal indicative of its being struck by a ball. FIG. 3 depicts one particular type of target including a plurality of infrared sources and detectors arranged in a matrix form. As will be apparent from this figure, the target 30 includes a plurality of sources of infrared energy 32 disposed along the top and left side of the target 30. The target further includes a plurality of light detecting elements 34 disposed along the bottom and right side periphery of the target 30. The infrared sources 32 are each adapted to emit a fairly narrow beam of infrared radiation and each of the detectors 34 is aligned with a source 32. Each detector 34 is adapted to receive infrared energy from its corresponding source 32. Toward this end the infrared sources 32 and detectors 34 will have associated therewith lenses, collimators or other such devices well known to those of skill in the art.

The infrared sources 32 and their corresponding detectors 34 are arranged in a matrix defining a grid having dimensions smaller than the diameter of the ball. For purposes of illustration herein, a first infrared source 32*a* is shown as projecting a first beam of infrared radiation 36 across the width of the target 30, for detection by an associated detector 34*a*. Likewise a second infrared source 32*b* and its associated detector 34*b* are shown as projecting and detecting a second beam of infrared radiation 38 across the height of the target. It will be appreciated that by energizing all of the infrared sources 32 and detectors 34 the entirety of the target 30 may be swept by infrared radiation and a ball passing thereacross will break a given pair of beams thereby locating itself positionally. If the processor were provided with information indicative of when the ball was hit, as for example by the player's signal 24 and with information regarding when the target was struck, the speed of the striking ball may be readily computed. In this manner, the target 30 of FIG. 3 is adapted to score both accuracy and speed of a player's return. While the FIG. 3 target was described with reference to infrared beams, it should be understood that other wavelengths of light may be similarly employed.

Figure 5:
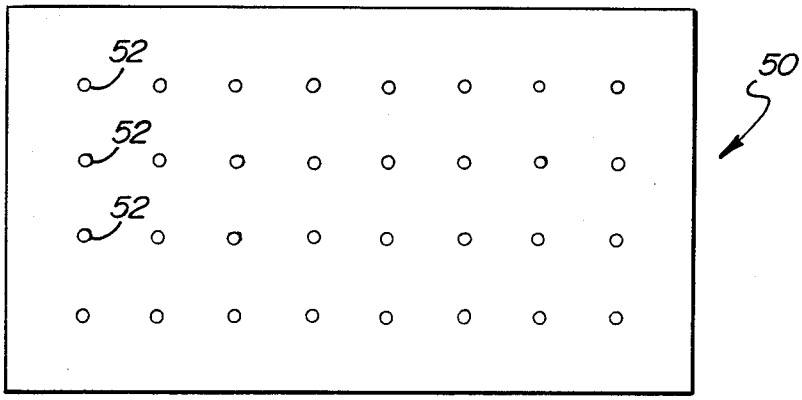
FIG. 5 is a rear elevational view of yet another target structured in accord with the principles of the present invention.

Obviously, other detection systems may be similarly employed. For example, referring to FIG. 5 there is shown a target 50 comprised of a solid member having a plurality of sensors 52 affixed thereto. Such sensors may be responsive to impact proximate thereto and may be of the type known as knock or vibration sensors. Such phonon sensitive sensors generally rely upon the use of sensitive microphones or the piezo electric effect to generate a signal. By the use of an array of such sensors the location of a strike by a return ball may be readily determined. Additionally, if the sensors 52 are adapted to provide an output corresponding to the strength of the strike, the energy of the return ball may obviously be calculated. It may in some instances by advantageous to employ a relatively flexible target member for the embodiment of FIG. 5 so as to prevent communication of strong signals from a strike in the region of one sensor 52 from interfering with the output of a neighboring sensor 52.

Figure 4:
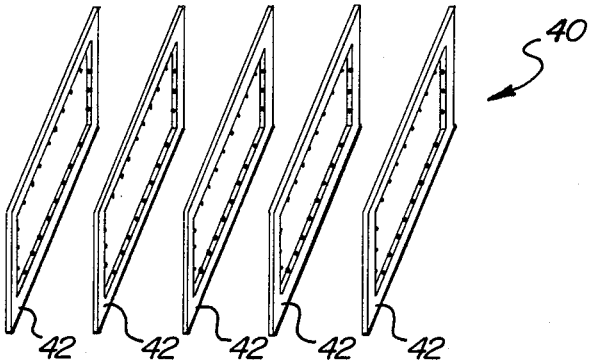
FIG. 4 is a perspective view of a target array of the present invention.

Referring now to FIG. 4 there is shown yet another target 40 usable in conjunction with the system of the present invention. The target 40 of FIG. 4 is comprised of a plurality of separate target sections 42, each of which is adapted to provide a positional signal indicative of the passage of a ball or similar object therethrough. Each of the target elements 42 of the target 40 of FIG. 4 is generally similar to the target described with reference to FIG. 3 insofar as there is included light beam means for positionally locating a ball. It will be appreciated that if a number of such target units 42 are provided both the speed and trajectory of a ball passing therethrough may be readily calculated. Such a multiple target system may also be employed in connection with a backstop type of target such as that 18, shown with reference to FIG. 1 so as to better track a hit or thrown ball.

A photoelectric type of detector array such as that shown in FIG. 3 or 4 may be employed to track the path of a bat or racquet to determine the accuracy of a player's swing. For example, an infrared sensor array can be used to delimit a strike zone and the processor can be programmed to determine where the bat and ball are in that zone. Information thus generated can appraise a player of a particular type of pitch he has difficulty hitting.

The system of the present invention may be adapted to further train a player to maintain eye contact with a pitched or hit ball, and to expand his field of vision to encompass the entire playing situation. Such training may be accomplished in a system in which the balls are imprinted with various indicia such as numbers, letters or other symbols; alternatively, the balls can be color coded. The ball delivery means can be readily adapted to sense the indicia directly, or to sense some other signal designating the indicia. Such sensing may be accomplished by bar code readers and the like.

When the ball is delivered, the player is required to observe the ball and call out the indicia thereupon, thus necessitating eye contact. The accuracy of the player's report of the indicia, as well as the speed with which it is called out can be readily ascertained by the processor, as for example through the use of voice recognition circuitry. In a batting situation, this mode of operation will teach a player to keep his eye on the ball, while in a fielding situation the player will be taught to "look the ball into the glove." In this manner, yet another parameter is added to the player's total score.

A voice recognition system can also be employed to sharpen a player's fundamental skills by requiring strict observation of a displayed game scene. For example, a player may be presented with a display of a game scene and be required to vocalize aspects of that scene. For example, the player may be required to call out if there are men on base or runners stealing in a baseball situation. Such calling out may comprise enunciation of the actual situation, or the calling out of a code, as for example the number on the base-runner's uniform. The object of this particular embodiment would be to expand a player's perception to encompass the totality of the playing field and train that player to respond appropriately. Obviously, other variants of the training system employing voice recognition circuitry will be apparent to one of skill in the art.

While the foregoing has been illustrated with specific reference to a baseball training system adapted to pitch a ball to a batter it should be clear that the present invention is not so limited but is intended to include all sports training systems adapted to deliver a ball, puck or similar playing game piece to a player for return and including a target capable of sensing the accuracy of such return, and/or the output of a signal generator associated with the player indicative of the return. All of the systems of the present invention are adaptive insofar as the delivery of the ball and/or the activation of a target will depend upon a player's skill level. For example, a tennis training system can provide progressively more difficult serves until a player has difficulty properly returning them to the appropriate portion of a target.

Targets utilized in conjunction with the present invention may employ various hit detecting technology well known to those of skill in the art and may further include indicating means to designate a portion of the target to be struck. Such indicators may include light bulbs, light emitting diodes or similar elements. In other instances, the target may have a projector associated therewith to impose a visible display thereon corresponding to indicated target sections.

In light of the foregoing it should be clear that numerous modifications and variations of the present invention are possible in accord with the teaching herein. Accordingly, the foregoing drawings, discussion and description are merely meant to be illustrative of particular embodiments of the present invention and not to be limitations thereupon. It is the following claims, including all equivalents, which define the scope of the invention.

I claim:

1. An adaptive sports training system for simulating play of a game, said system including:

means for delivering a ball to a player;

target means disposed so as to be struck by a ball projected by the player and operative to provide a signal indicative of the skill with which the target is struck; and a signal processor comprising means for (1) receiving signals from the target means and (2) controlling at least one of said ball delivery means or said target means in response to said signals so as to increase or decrease the difficulty of the game in proportion to the skill with which the target is struck so that the system adapts to and accommodates the skill level of the player.

2. A system as in claim 1, wherein said processor is further operative to receive signals from the delivery means indicative of the delivery of the ball.

3. A system as in claim 2, wherein said processor is operative to control the target in response to signals received from the delivery means.

4. A system as in claim 3, wherein said target includes a plurality of regions and the processor controls the target so as to indicate which region is to be struck.

5. A system as in claim 3, wherein said target includes a plurality of regions and the processor controls the value of each of said regions in response to the delivery of the ball so that the signal from the target depends upon the regions struck as well as the nature of the delivery of the ball.

6. A system as in claim 1, wherein said processor includes display means associated therewith.

7. A system as in claim 6, wherein said display means includes a cathode ray tube.

8. A system as in claim 6, wherein said display means is operative to project a visual pattern on the target.

9. A system as in claim 6, wherein said display means is operative to provide a visual simulation of a game and wherein the processor is operative to compute a score indicative of the player's performance based upon the signal from the target and the particular visual simulation presented.

10. A system as in claim 6, wherein said display is operative to provide a score indicative of the player's skill.

11. A system as in claim 1 wherein the target is operative to provide a signal indicative of the energy of the ball which strikes it.

12. A system as in claim 1, wherein said target includes a plurality of distinct regions, each region is operative to provide a distinct signal when struck by the ball.

13. A system as in claim 12, wherein said target includes indicia designating said distinct regions.

14. A system as in claim 1, wherein said target includes infrared sensing means for detecting a strike by the ball.

15. A system as in claim 1, wherein said target includes photosensitive means for detecting a strike by the ball.

16. A system as in claim 1, wherein said delivery means is operative to simulate the pitching of a baseball to the player.

17. A system as in claim 1, wherein said delivery means is operative to simulate the hitting of a ball to the player.

18. A system as in claim 1, further including signal means associated with the player and operatively communicating with the processor.

19. A system as in claim 18, wherein said signal means comprises a mechanical switch.

20. A system as in claim 18, wherein said signal means comprises a microphone.

21. A system as in claim 18, wherein said signal means comprises a voice recognition circuit.

22. A system as in claim 21, wherein the delivered ball includes indicia thereupon, readable by the player, and said voice recognition circuit is operative to interpret a vocalization corresponding to said indicia, and score the player as to the accuracy of said vocalization.

23. A system as in claim 21, further including target means operative to display a game situation and wherein said voice recognition circuit is adapted to interpret a vocalization corresponding to said indicia and score the player as to the accuracy of the vocalization.

24. A system as in claim 21, wherein said voice recognition circuit includes at least one microphone in operative communication with the processor.

25. An adaptive sports training system including:

means for delivering a ball to a player;

a target disposed so as to be struck by a ball projected by the player and including a plurality of regions, said target having at least one sensor associated with each region to provide a unique signal indicative of the region being struck by the ball;

a signal processor disposed in electrical communication with the target and the delivery means and comprising means for (1) receiving signals from the target, (2) evaluating said signals so as to assess the player'level of skill, (3) providing a scoring signal indicative of said skill level, and (4) controlling the delivery means in response to the scoring signal; and, display means in electrical communication with the signal processor further operative to (1) receive electrical signals from the ball delivery means indicative of the nature of the delivery of the ball to the player and (2) control the target in response to the signal from the ball delivery means.

26. A system as in claim 25, further including means for projecting a visual display upon said target.

27. A system as in claim 26, wherein said projection means is operative to be operatively controlled by the signal processor.

28. A system as in claim 25, wherein said ball includes visual indicia thereupon and wherein said processor has voice recognition means associated therewith operative to receive a vocal input from the player corresponding to said visual indicia and evaluate said vocal input to determine the appropriateness thereof.

29. An adaptive sports training system for simulating play of a game, said system including:

means for delivering a ball to a player;

means for striking the ball;

a signal generator associated with the striking means for generating an impact signal when said striking means contacts the ball, said impact signal indicative of the player's skill level in hitting the ball; and a signal processor comprising means for receiving the impact signal and controlling the ball delivery means in response thereto so as to increase or decrease the difficulty of the game in response to the player's skill level so that the system adapts to and accommodates the skill level of the player.

30. A system as in claim 29, wherein said striking means comprises a bat.

* * * * *